US010011994B1

(12) United States Patent
Market

(10) Patent No.: US 10,011,994 B1
(45) Date of Patent: Jul. 3, 2018

(54) FLAT ROOF FASTENING SYSTEM

(71) Applicant: Bradley D. Market, North Fort Myers, FL (US)

(72) Inventor: Bradley D. Market, North Fort Myers, FL (US)

( * ) Notice: Subject to any disclaimer, the term of this patent is extended or adjusted under 35 U.S.C. 154(b) by 22 days.

(21) Appl. No.: 15/251,503

(22) Filed: Aug. 30, 2016

(51) Int. Cl.
*B25C 1/04* (2006.01)
*E04D 15/04* (2006.01)

(52) U.S. Cl.
CPC ..... *E04D 15/04* (2013.01); *E04D 2015/047* (2013.01)

(58) Field of Classification Search
CPC ..... E04D 15/04; E04D 2015/047
USPC ..... 52/749.12
See application file for complete search history.

(56) References Cited

U.S. PATENT DOCUMENTS 2,540,106 A 2/1951 Eichelberger
3,629,931 A * 12/1971 Stanley ..... B27F 7/02 100/913
4,081,120 A 3/1978 Epes
5,347,707 A * 9/1994 Beach ..... B25B 21/002 29/787
5,445,297 A 8/1995 Beach et al.
5,555,780 A 9/1996 Beach et al.
5,584,415 A 12/1996 Beach et al.
5,921,454 A 7/1999 Larson et al.
6,142,352 A 11/2000 Larson et al.
6,363,684 B1 * 4/2002 Alderman ..... E04D 13/1625 52/404.3
6,401,426 B1 * 6/2002 Alderman ..... E04D 13/1625 52/745.06
8,492,683 B2 7/2013 Challita et al.
8,933,379 B2 1/2015 Challita et al.
9,259,852 B2 2/2016 Freeman
2003/0213112 A1 * 11/2003 Seamons ..... E04D 3/364 29/243.5
2013/0228287 A1 * 9/2013 Bessette ..... B29C 63/0065 156/499
2015/0076139 A1 3/2015 Challita et al.

* cited by examiner

*Primary Examiner* — Charles A Fox
*Assistant Examiner* — James Buckle, Jr.
(74) *Attorney, Agent, or Firm* — Edward M. Livingston, Esq.; Bryan L. Loeffler, Esq.; Livingston Loeffler, P.A.

(57) ABSTRACT

A flat roof washer and heat welding installation system (1) for securing rigid roofing panels and overlaying membranes to a flat roof truss system comprising one or more wheeled carts having a plurality of screw guns (12) and/or heat welding heads (16) arranged in grid patterns to allow for quick and even installation of screwed washers and heat welds on a flat roof.

11 Claims, 4 Drawing Sheets

10
12
11
14

3

5
4
9
6
1
7
8

FLAT ROOF FASTENING SYSTEM

FIELD OF THE INVENTION

This invention pertains to the installation of flat roofs over large areas and more particularly to an apparatus for securing an underlayment of rigid roofing panels and a layer of membrane to a roof support structure.

BACKGROUND OF THE INVENTION

Many large structures, especially commercial structures, commonly have flat roofs supported by a truss system. Such flat roofs are made up of an underlayment of rigid panels secured to the trusses using screws and washers. The underlayment of rigid panels are then covered by a waterproof membrane that is rolled out across the underlayment and secured thereto by heat welding the membrane to the screws and washers holding the rigid panels to the truss system.

Currently, the installation of the screws and washers and the subsequesnt heat welding is performed by hand with hand held tools and/or standup tools that install each screw and washer and each heat weld one at a time. This process of course, is quite time consuming when installing a flat roof over structures that are sometimes acres in size. In addition, there are other difficulties with the current process, which includes installing the screws and washers in straight lines and being able to evenly spacing the screws and washers apart from each other. The placement of the screws and washers are commonly eyeballed by a worker installing same resulting in improper placement and/or spacing. The improper placement and/or spacing leads to additional problems when heat welding the membrane to the screw heads and washers. The main problem is finding each screw head and washer after the membrane has been rolled over the underlayment and the screws and washers, thus resulting in many of the screw heads and washers being missed during the heat welding process. This also results in uneven lines and improperly spaced heat welds that are unattractive and can affect the integrity of the roof. An additional problem affecting the appearance of the roof is caused by workers kicking the membrane to find washers underneath. This causes scuffs and dirt on the membrane that are then melted into the membrane further causing an unattractive finished product.

Therefore, a need exists for a flat roof washer and heat welding installation system and process that speeds up the installation process of a flat roof, evenly places and spaces the washers and screws securing the underlayment to the truss system in a grid pattern so the washers and screws may be easily found after being covered with a membrane, and a welding system that matches the grid pattern of the installed screws and washers to ensure that every washer and screw is heat welded to the overlying membrane.

SUMMARY OF THE INVENTION

The primary object of the present invention is to provide a flat roof washer and heat welding installation system that speeds up the installation process of a flat roof.

An additional object of the present invention is to provide a flat roof washer and heat welding installation system that evenly places and spaces washers and screws securing an underlayment to a deck system in a grid pattern so the washers and screws may be easily found after being covered with a membrane.

An additional object of the present invention is to provide a flat roof washer and heat welding installation system that matches the grid pattern of the installed screws and washers to ensure that every washer and screw is heat welded to the overlying membrane and the resulting installed roof is aesthetically pleasing.

The present invention fulfills the above and other objects by providing a flat roof washer and heat welding installation system for securing rigid roofing panels and overlaying membranes to a flat roof truss system comprising one or more wheeled carts having a plurality of screw guns and/or heat welding heads arranged in a grid pattern. The cart is aligned on top of trusses and rolled in a straight path securing the rigid roofing panels to the trusses as the cart is rolled over the span of the roof. The device dispenses washers at desired intervals which are then secured using the plurality of screw guns that drop down to insert the screws through respective washers and into the trusses. A membrane is then rolled over the washers and rigid roofing panels. Then, heat welding heads arranged in the same grid pattern as the screw guns are rolled over the washers and membrane and lowered over the secured washers, thereby sandwiching the membrane between the washers and the welding heads for a predetermined amount of time in order to slightly melt the membrane so that the membrane adheres to the washers.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
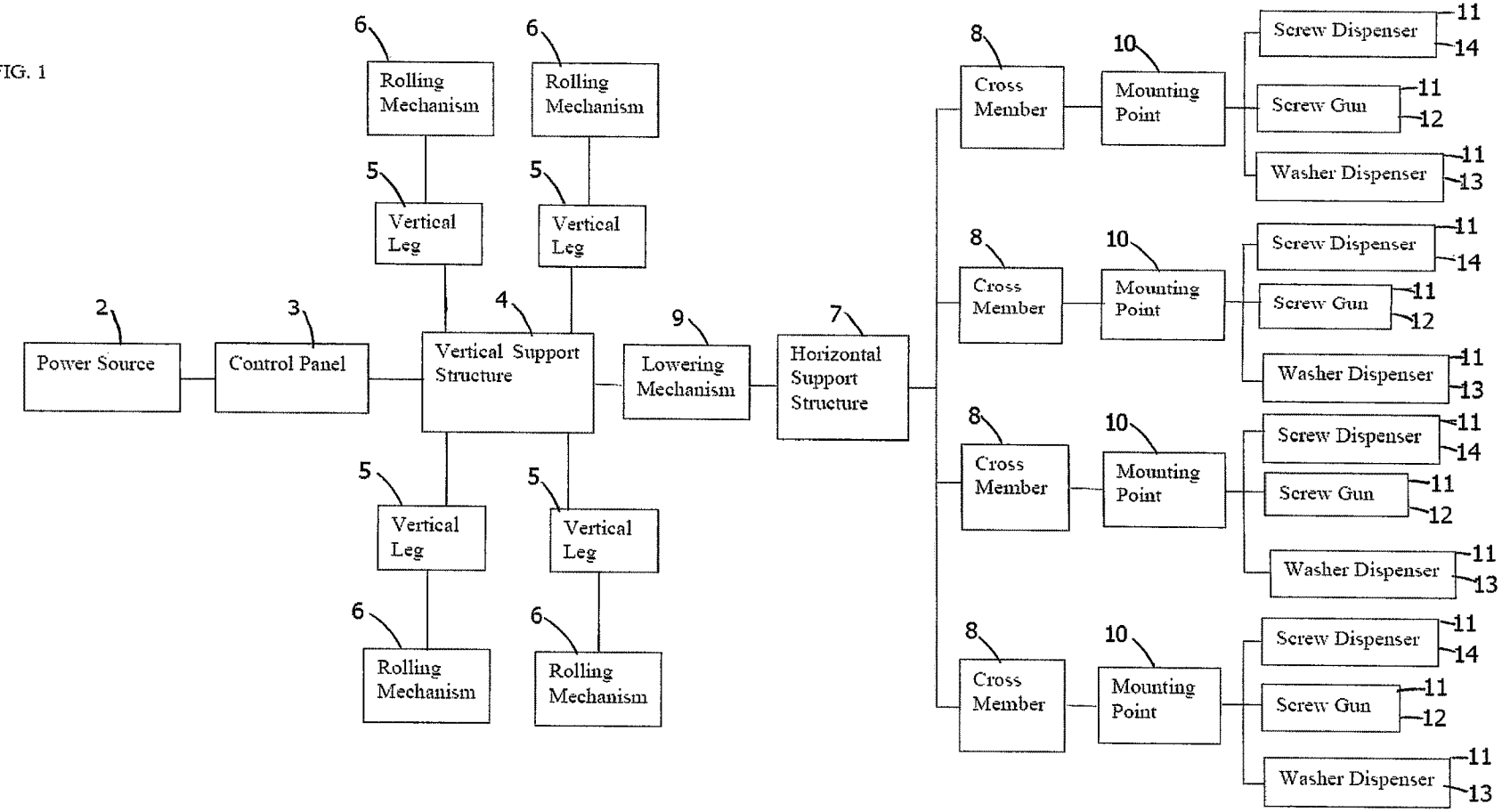
FIG. 1 is a block diagram showing the components making up the flat roof fastening system of the present invention wherein components used for fastening rigid roof panels are mounted to a horizontal support structure.
Figure 2:
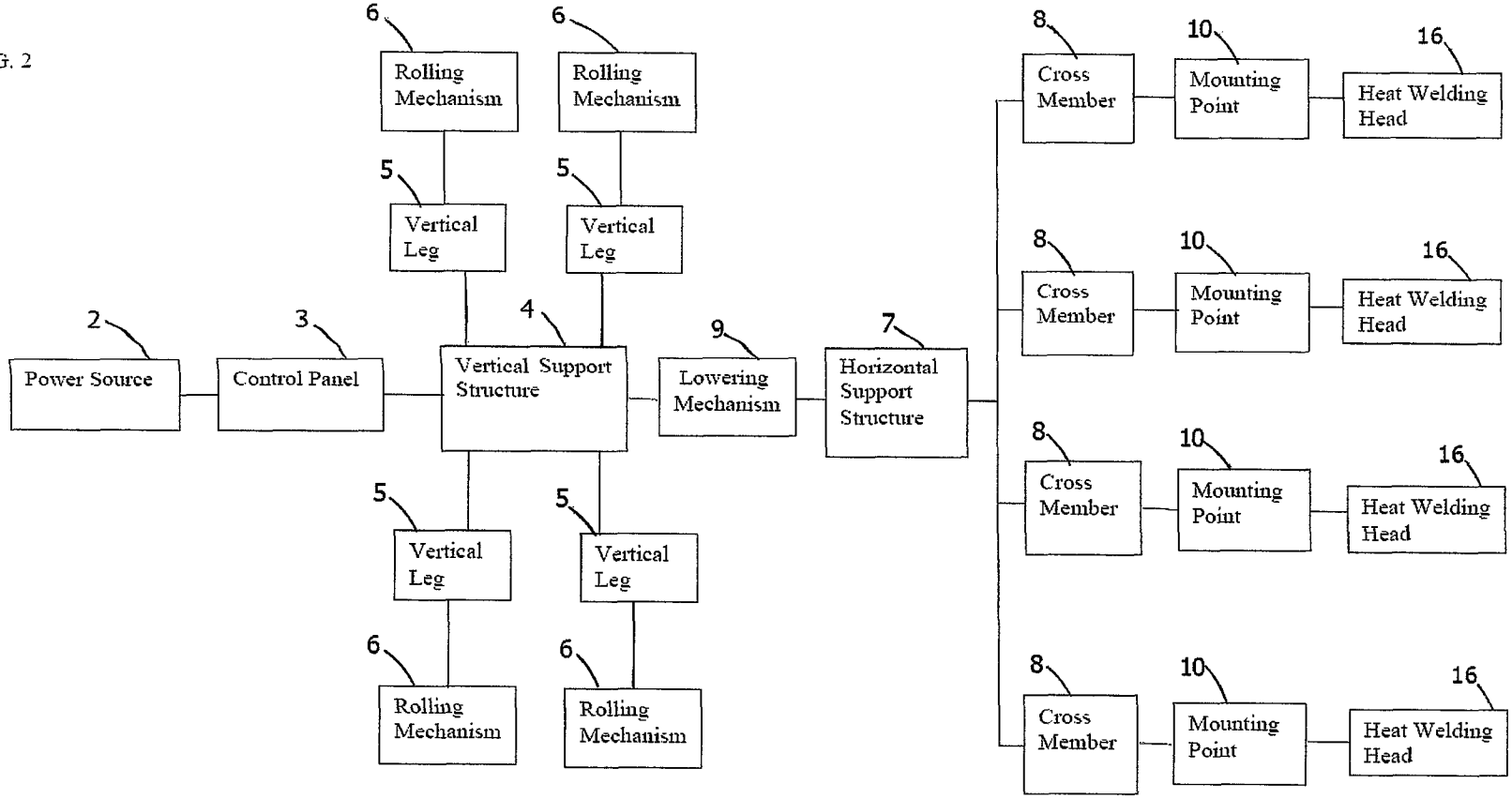
FIG. 2 is a block diagram showing the components making up the flat roof fastening system of the present invention wherein components used for fastening a waterproof membrane to metal washers are mounted to a horizontal support structure.
Figure 10:
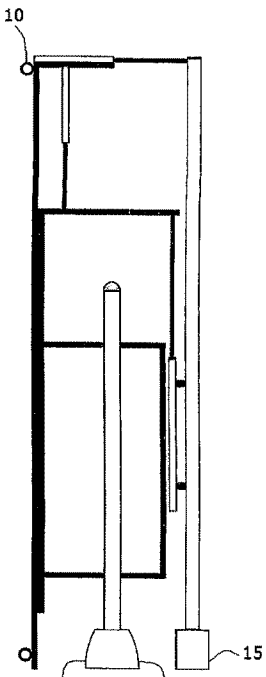
FIG. 10 is a side view of the components used for fastening a waterproof membrane to metal washers are mounted to a horizontal support structure.
Figure 5:
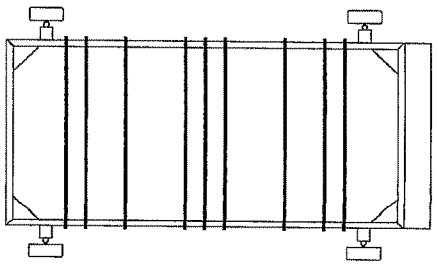
FIG. 5 is a bottom view of a horizontal support structure flat roof fastening system of the present invention wherein components used for fastening a waterproof membrane to metal washers are mounted.
Figure 4:
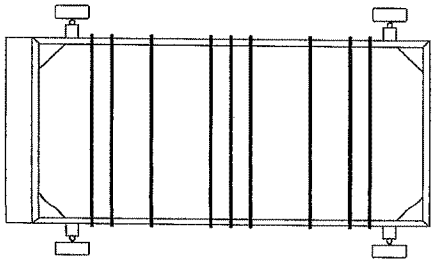
FIG. 4 is a top view of a horizontal support structure flat roof fastening system of the present invention wherein components used for fastening a waterproof membrane to metal washers are mounted.
Figure 8:
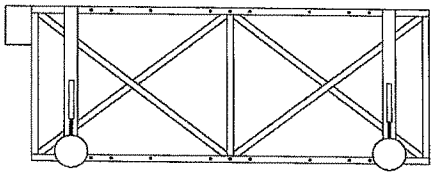
FIG. 8 is a right side view of a horizontal support structure flat roof fastening system of the present invention wherein components used for fastening a waterproof membrane to metal washers are mounted.
Figure 9:
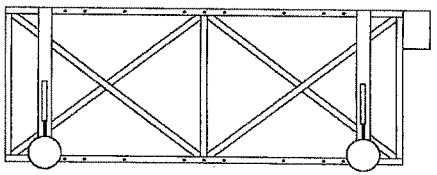
FIG. 9 is a rear side view of a horizontal support structure flat roof fastening system of the present invention wherein components used for fastening a waterproof membrane to metal washers are mounted.
Figure 6:
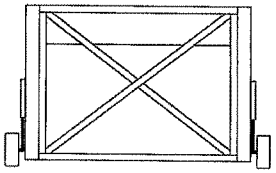
FIG. 6 is a front view of a horizontal support structure flat roof fastening system of the present invention wherein components used for fastening a waterproof membrane to metal washers are mounted.
Figure 7:
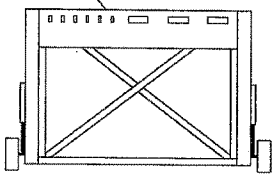
FIG. 7 is a rear view of a horizontal support structure flat roof fastening system of the present invention wherein components used for fastening a waterproof membrane to metal washers are mounted.
Figure 3:
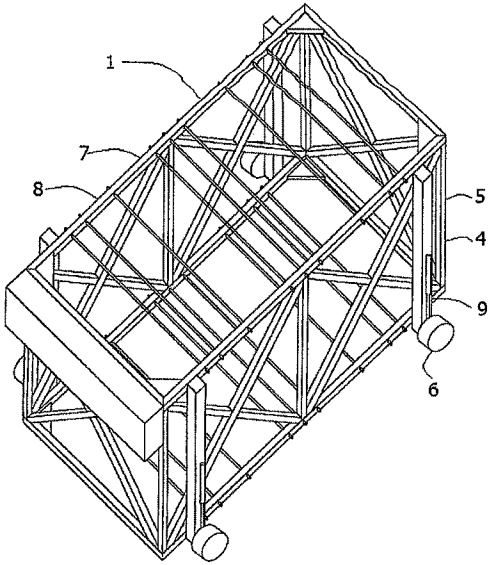
FIG. 3 is a perspective side view of a horizontal support structure flat roof fastening system of the present invention wherein components used for fastening a waterproof membrane to metal washers are mounted.
Figures 11, 12, 13, 14, 15, 16, 17, 18:
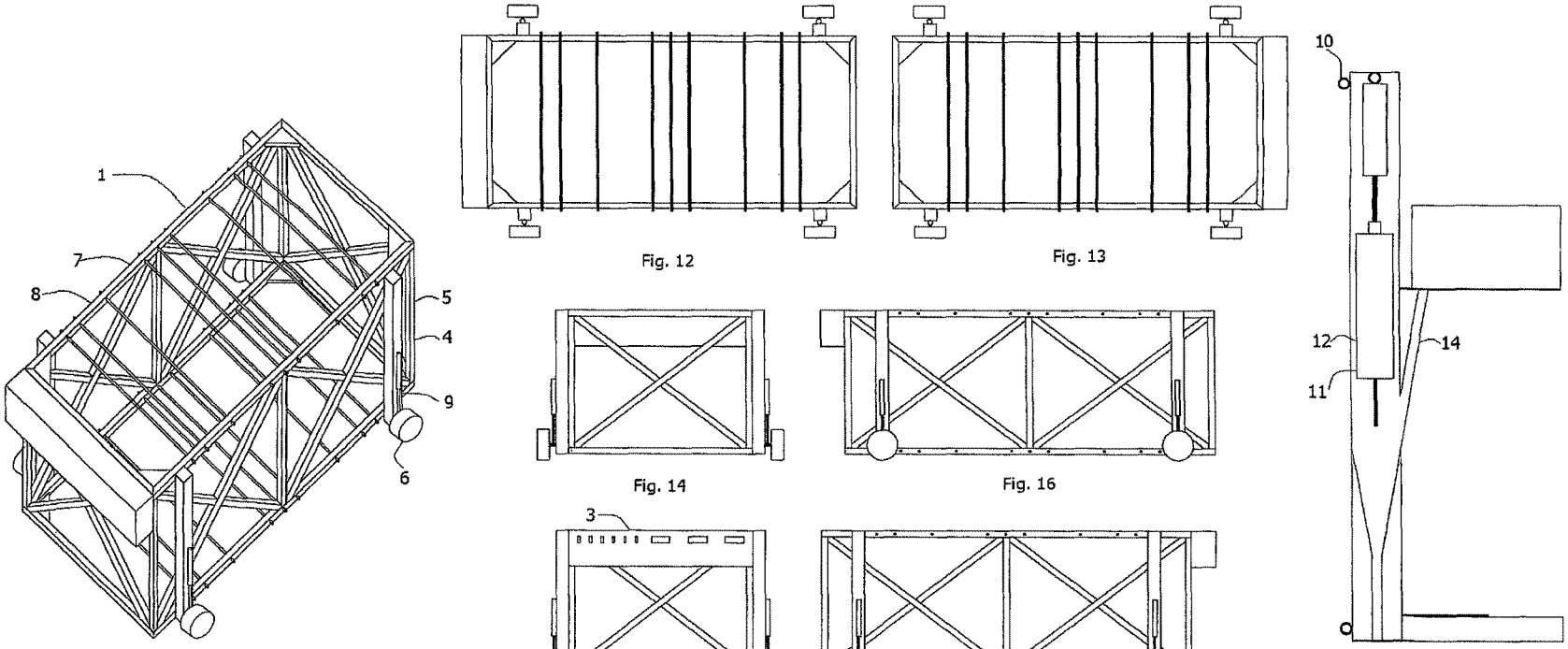
FIG. 11 is a perspective side view of a horizontal support structure flat roof fastening system of the present invention wherein components used for fastening rigid roof panels are mounted to a horizontal support structure.
FIG. 12 is a top view of a horizontal support structure flat roof fastening system of the present invention wherein components used for fastening rigid roof panels are mounted to a horizontal support structure.
FIG. 13 is a bottom view of a horizontal support structure flat roof fastening system of the present invention wherein components used for fastening rigid roof panels are mounted to a horizontal support structure.
FIG. 14 is a front view of a horizontal support structure flat roof fastening system of the present invention wherein components used for fastening rigid roof panels are mounted to a horizontal support structure.
FIG. 15 is a rear view of a horizontal support structure flat roof fastening system of the present invention wherein components used for fastening rigid roof panels are mounted to a horizontal support structure.
FIG. 16 is a right side view of a horizontal support structure flat roof fastening system of the present invention wherein components used for fastening rigid roof panels are mounted to a horizontal support structure.
FIG. 17 is a rear side view of a horizontal support structure flat roof fastening system of the present invention wherein components used for fastening rigid roof panels are mounted to a horizontal support structure.
FIG. 18 is a side view of the components used for fastening rigid roof panels are mounted to a horizontal support structure.

For purposes of describing the preferred embodiment, the terminology used in reference to the numbered components in the drawings is as follows:

1. flat roof fastening system, generally
2. power supply
3. control panel
4. vertical support structure
5. vertical leg
6. rolling mechanism
7. horizontal support structure
8. cross member
9. lowering/raising mechanism
10. mounting point
11. fastening mechanism
12. screw gun
13. washer dispenser
14. screw dispenser
15. locating sensor
16. heat welding head With reference to FIGS. 1 and 2, the flat roof fastening system 1 of the present invention comprises a power supply 2 and control panel 3 located on a vertical support structure 4 having at least four vertical legs 5 with rolling mechanisms 6, such as one or more wheels, located on bottom ends of the vertical legs 5 to allow the flat roof fastening system 1 to be rolled into position for operation. A horizontal support structure 7 is supported in an elevated position by the vertical support structure 4. The horizontal support structure 7 preferably comprises a plurality of cross members 8 that may be parallel and/or perpendicular to each other to form a grid-like pattern. One or more lowering/raising mechanisms 9 are located between the vertical support structure 4 and the horizontal support structure 7 to allow the horizontal support structure 7 to be lowered from an elevated position to place and/or engage a plurality of fastening means, such as screws, washers and so forth, and then raised back into the elevated position so that the flat roof fastening system 1 may be rolled forward and repositioned for further placement and/or engagement of additional fastening means.

The cross members 8 of the horizontal support structure 7 provide mounting points 10 for a plurality of fastening mechanisms 11, such as screw guns 12 (as illustrated in FIG. 1), washer dispensers 13 (as illustrated in FIG. 1), screw dispensers 14 (as illustrated in FIG. 1), and/or heat welding heads 16 (as illustrated in FIG. 2). The plurality of fastening mechanisms 11 are preferably arranged in a linear or grid-like pattern.

With reference to FIG. 1, a block diagram showing the components making up the flat roof fastening system 1 of the present invention wherein components used for fastening rigid roof panels are mounted to a horizontal support structure 7 is illustrated. A plurality of screw guns 12 are secured to the plurality of cross members in downward positions that allow the screw guns 12 to be lowered in unison in a manner that allows the screw guns 12 to engage one or more screws that are each inserted into a washer and then screwed through one or more sheets of rigid underlayment and into a truss system to secure the underlayment to the truss system. The rolling mechanisms 6 of the flat roof fastening system 1 are preferably spaced apart to span a plurality of trusses, thereby allowing the screw guns 12 to be positioned on the horizontal support structure 7 and cross members 8 thereof in positions that are directly above the spanned trusses to ensure that the screw guns 12 engage the spanned trusses with the respective trusses when the screw guns are lowered. The screw guns each preferably comprise an independent suspension that allows the screw guns to be lowered evenly across an uneven surface. In addition, the screw guns 12 each preferably comprise depth gauges with limiting switches and/or torque gauges to deactivate each screw gun independently when a screw is fully secure in relation to a washer and the rigid roof panel being secured. Therefore, all of the screw guns 12 are activated in unison when lowered but may deactivate independently to prevent over screwing.

A plurality of automatic washer dispensers 13 are preferably secured to the cross members 8 of the horizontal support structure 7 each being proximate to a respective screw gun 12. Each automatic washer dispenser 13 automatically places a washer in position on top of the underlayment directly below the respective screw gun 12 so that the washer may be secured to the underlayment and truss of the structure using a screw.

A plurality of automatic screw dispensers 14 are preferably secured to the cross members 8 of the horizontal support structure 7, each being proximate to a respective screw gun 12. Each automatic screw dispenser 14 automatically places a screw in position to be screwed by the respective screw gun 12 through a washer and through the underlayment and into a truss of the structure.

With reference to FIG. 2, a block diagram showing the components making up the flat roof fastening system 1 of the present invention wherein components used for fastening a waterproof membrane to metal washers are mounted to a horizontal support structure 7 is illustrated.

A plurality of heat welding heads 16 are secured to the plurality of cross members in downward positions that allow the heat welding heads 16 to be lowered in unison in a manner that allows the heat welding heads 16 to press downward on the waterproof membrane and washers located beneath the waterproof membrane, thereby sandwiching the membrane between the washers and the heat welding heads 16 for a predetermined amount of time in order to slightly melt the membrane so that the membrane adheres to the washers.

One or more automatic locating sensors 15, such as a metal detector, magnet and so forth, are preferably located on the flat roof fastening system 1 to locate washers hidden by the waterproof membrane. After two more washers are located, the heat welding heads 16 may be lowered to make contact with washers that were installed in a corresponding grid pattern of the heat welding heads using the flat roof fastening system 1 of the present invention.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A flat roof fastening system comprising:

a power supply connected to a control panel located on a vertical support structure having at least four vertical legs;

a rolling mechanism located on a bottom end of each of the four vertical legs to allow the flat roof fastening system to be rolled into position for operation;

a horizontal support structure supported in an elevated position by the vertical support structure;

said horizontal support structure comprising a plurality of perpendicular cross members extending between two parallel cross members wherein said perpendicular cross members are perpendicular to the two parallel cross members;

at least one lowering mechanism for lowering the horizontal support system from the elevated position;

a plurality of mounting points located on the plurality of perpendicular cross members of the horizontal support structure for supporting a plurality of fastening mechanisms on the cross members of the horizontal support structure; and said plurality of fastening mechanisms comprise a plurality of screw guns in downward positions.

2. The flat roof fastening system of claim 1 wherein said plurality of fastening mechanisms further comprises:

a plurality of screw dispensers.

3. The flat roof fastening system of claim 1 wherein said plurality of fastening mechanisms comprise:

a plurality of washer dispensers.

4. The flat roof fastening system of claim 1 wherein said plurality of fastening mechanisms comprise:

a plurality of heat welding heads.

5. The flat roof fastening system of claim 4 further comprising:

at least one locating sensor.

6. A flat roof fastening system comprising:

a power supply connected to a control panel located on a vertical support structure having at least four vertical legs;

a rolling mechanism located on a bottom end of each of the four vertical legs to allow the flat roof fastening system to be rolled into position for operation;

a horizontal support structure supported in an elevated position by the vertical support structure;

said horizontal support structure comprising a plurality of perpendicular cross members extending between two parallel cross members wherein said perpendicular cross members are perpendicular to the two parallel cross members;

at least one lowering mechanism for lowering the horizontal support system from the elevated position;

a plurality of mounting points located on the plurality of perpendicular cross members of the horizontal support structure for supporting a plurality of fastening mechanisms on the cross members of the horizontal support structure; and said plurality of fastening mechanisms comprise a plurality of heat welding heads in downward positions.

7. The flat roof fastening system of claim 6 wherein said plurality of fastening mechanisms comprise:

a plurality of screw guns.

8. The flat roof fastening system of claim 7 wherein said plurality of fastening mechanisms further comprises:

a plurality of screw dispensers.

9. The flat roof fastening system of claim 6 wherein said plurality of fastening mechanisms comprise:

a plurality of washer dispensers.

10. The flat roof fastening system of claim 7 wherein said plurality of fastening mechanisms comprise:

a plurality of washer dispensers.

11. The flat roof fastening system of claim 6 further comprising:

at least one locating sensor.

* * * * *